US007273407B2

(12) United States Patent
Saikin

(10) Patent No.: US 7,273,407 B2
(45) Date of Patent: Sep. 25, 2007

(54) TRANSPARENT POLISHING PAD

(75) Inventor: Alan H. Saikin, Landenberg, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/494,434

(22) Filed: Jul. 27, 2006

(65) Prior Publication Data

US 2007/0042682 A1 Feb. 22, 2007

Related U.S. Application Data

(60) Provisional application No. 60/709,236, filed on Aug. 18, 2005.

(51) Int. Cl.
*B24B 5/00* (2006.01)

(52) U.S. Cl. ..... 451/6; 451/285; 451/288

(58) Field of Classification Search ..... 451/6, 451/37, 56, 58, 41, 298, 490, 285–290, 526–529; 438/8, 691–693; 156/345.11, 345.12, 345.13
See application file for complete search history.

(56) References Cited

U.S. PATENT DOCUMENTS 5,893,796 A 4/1999 Birang et al.
5,976,000 A * 11/1999 Hudson ..... 451/534
6,517,417 B2 * 2/2003 Budinger et al. ..... 451/41
6,685,540 B2 2/2004 Cherian et al.
6,832,947 B2 * 12/2004 Manning ..... 451/41
6,832,949 B2 * 12/2004 Konno et al. ..... 451/285
6,848,974 B2 2/2005 Hasegawa et al.
6,855,034 B2 * 2/2005 Hasegawa ..... 451/41
6,945,846 B1 * 9/2005 Petroski et al. ..... 451/6
2002/0077036 A1 6/2002 Roberts et al.
2004/0053007 A1 3/2004 Huh et al.
2004/0082276 A1 4/2004 Prasad
2004/0203320 A1 10/2004 Husaka et al.
2004/0244299 A1 12/2004 Ogawa et al.
2004/0259484 A1 12/2004 Prasad et al.
2005/0014376 A1 1/2005 Shiho et al.
2005/0215177 A1 9/2005 Prasad

* cited by examiner

*Primary Examiner*—Lee D. Wilson
*Assistant Examiner*—Anthony Ojini
(74) *Attorney, Agent, or Firm*—Blake T. Biederman

(57) ABSTRACT

The present invention relates to a polishing pad useful for planarizing a substrate in a CMP process using a polishing composition. The polishing pad is transparent and allows for the use of an in-situ optical end-point detection apparatus without the need for a separate aperture or window in the polishing pad.

9 Claims, 4 Drawing Sheets

TRANSPARENT POLISHING PAD

CROSS REFERENCE TO RELATED APPLICATION

This application claims the benefit of U.S. Provisional Application Ser. No. 60/709,236 filed Aug. 18, 2005.

BACKGROUND

The present invention generally relates a polishing pad useful for polishing and planarizing substrates using a chemical-mechanical planarization ("CMP") process. More particularly, the present invention provides a polymeric matrix polishing pad containing embedded polymeric capsules useful in conjunction with an in-situ optical end-point detection device.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches and contaminated layers or materials.

In a typical CMP process, a lower platen having a circular rotating plate holds a polishing pad; the polishing pad is attached such that the polishing surface of the polishing pad faces up. A polishing composition, that typically contains chemistry that interacts with the substrate and may contain abrasive particles, is supplied to the polishing surface of the polishing pad. An upper platen having a rotating carrier holds a substrate; the substrate is held such that the surface to be planarized faces down. The carrier is positioned so that its axis of rotation is parallel to and is offset from that of the polishing pad; additionally, the carrier can be oscillated or otherwise moved about the surface of the polishing pad as is appropriate for the CMP process. The substrate and the polishing pad are brought into contact and forced together with downward pressure by the upper platen, whereby the polishing composition on the surface of the polishing pad is contacted with the surface of the substrate (the working environment), allowing the chemistry to react with the substrate, and mechanical polishing takes place.

Polishing pads can be manufactured in a variety of ways, such as casting a cake or by casting a sheet. In a typical manufacturing process, the polymer pad material ingredients, which may include one or more pre-polymers, cross-linking agents, curing agents and abrasives, are mixed, resulting in a resin. The resin is transferred to a mold by pouring, pumping or injecting etc. The polymer typically sets quickly and may finally be transferred to an oven for completion of the curing process. The cured cakes or sheets are then cut to a desired thickness and shape.

Polishing pad surface asperities aid in transporting the polishing composition during the CMP process and can be created on the polishing surface of the polishing pad in many ways. According to one method, surface asperities are created by embedding hollow polymeric capsules in a polishing pad comprising a polymeric matrix. Specifically, surface asperities are created by rupturing the capsules and exposing the hollow void contained therein to the working environment on the surface of the polishing pad. This may be accomplished by conditioning the polishing pad.

Typically, conditioning consists of abrading the polishing surface of the polishing pad with diamond points (or other scoring or cutting means) embedded in the conditioning surface of a conditioning pad. As the conditioned polishing pad is used, the asperities wear away and become clogged with debris from the CMP process. This results in the loss of polishing pad surface asperities with continued use. Asperities can be regenerated, as the polishing surface is worn during the CMP process, by continuous or intermittent conditioning. Asperities can also be regenerated during the polishing process, without abrasive conditioning, as the embedded polymeric capsules are exposed to the polishing surface and ruptured. For convenience, the term conditioning refers to regeneration of surface asperities whether through pad wear exposing new asperities, through the use of a conditioning pad or through other regeneration techniques.

In addition to transportation of the polishing composition, the polishing composition must flow over the surface of the polishing pad for the polishing process to be effective. This flow is aided by large-scale texture. Large-scale texture is created on the polishing surface of the polishing pad by the introduction of grooves. Groove pattern design and groove dimensions affect polishing pad characteristics and the CMP process characteristics. Polishing pad grooving is well known in the art, and known groove designs include radial, circular, spiral, x-y and others. Typically, grooves are introduced in the polishing surface of a polishing pad after it is formed through mechanical means such as cutting, using a fixed blade, such as a chisel, or other cutting means, but may be integrally formed in the pad, or created by stamping.

It is important to stop the CMP process when the desired amount of material has been removed from the surface of the substrate. In some systems, the CMP process is continually monitored throughout in order to determine when the desired amount of material has been removed from the surface of the substrate, without stopping the process. This is typically done by in-situ optical end-point detection. In-situ optical end-point detection involves projecting laser (or some other) light through an aperture or a window in the polishing pad from the platen side so that the laser light is reflected off the polished surface of the substrate and is collected by a detector. These systems work well for optically transparent polishing pads, but are typically not useful for filled pads.

A typical pad used in the CMP process is IC1000™ polishing pads manufactured and sold by Rohm and Haas Electronic Materials CMP Technologies. As illustrated in FIG. 1, these pads 10 have a clear matrix 12 and porosity formed from gas-filled polymeric spheres 14. The large difference between the refractive indexes of the clear matrix 12 and the polymeric spheres 14 corresponds to a large degree of refraction. This refraction, especially when large numbers of interfaces are encountered for high porosity polishing pads, creates opacity because light entering the polishing pad is substantially refracted and does not travel through the polishing pad with sufficient freedom to reflect back through the pad for effective signal generation.

FIG. 2 illustrates the optical path of a typical gas-filled sphere 14 of the prior art. The polymeric capsule 14 has a polymeric shell 16 having a first refractive index, a gas core 18 having a second refractive index, a first interface 20 where the polymeric shell 16 contacts the polymeric matrix material 12, and a second interface 22 where the polymeric shell 16 contacts the gas core 18. The refractive index of the gas core 18 differs from the polymeric shell 16 by an unacceptable amount for most commercial polishing equipment. Light ray 24 is shown traveling through the polymeric matrix material 12, where it encounters the first interface 20 and is refracted slightly. Light ray 24 travels through the polymeric shell 16 where it encounters the second interface 22 and is partially reflected (discussed more below) as shown by light ray 26, and partially refracted as shown by light ray 28. Light ray 28 travels through the gas core 18 until it contacts the second interface 22 a second time, where it is again partially reflected, shown as light ray 30, and partially refracted, as shown by light ray 32. Light ray 32 encounters the first interface 20, is slightly refracted, and exits the polymeric capsule 14 with a significant signal loss. Furthermore, reflected light ray 30 travels through the gas core 18 until it encounters the second interface 22 where it is partially reflected, shown as light ray 34, and partially refracted, shown as light ray 36.

One such window is disclosed in U.S. Pat. No. 5,893,796, to Birang at al, in which the window is made of a clear polymer and is inserted into an aperture formed in a polishing pad. The amount of light that is reflected from the surface of the substrate corresponds to the amount of material that has been removed. When the amount of light detected equals a predetermined value, the CMP process has reached the desired end-point and the CMP process is terminated.

The window of the '796 patent may be inserted into a formed pad in which an aperture has been made to receive the window, or alternatively the window may be cast in place. Any method of manufacturing a polishing pad with a window according to the '796 patent, however, results in a two (or more) piece polishing pad. As a result, polishing composition may enter into the seam between the polishing pad material and the window material, and may leak through the polishing pad, interfering with the in-situ optical end point detection apparatus. Many attempts have been made to reduce or eliminate this phenomenon, for example, by covering the bottom of the polishing pad with an impermeable film. This method, however, involves additional steps and new materials into the manufacturing process, which is inefficient and costly. In addition, the window material is frequently different from the polishing pad material, and has different characteristics than the polishing pad material, which may adversely affect polishing.

Hence, what is needed is a porous polishing pad that is transparent and allows inspection of the surface of the substrate without the need for a separate window.

STATEMENT OF INVENTION

The invention provides a transparent polishing pad useful for polishing a substrate in a chemical mechanical polishing process using a polishing composition and an in-situ optical end-point detection apparatus, the polishing pad comprising: a polymeric matrix material having a first refractive index; a plurality of polymeric capsules having cavities embedded within and optically connected to the polymeric matrix material, the polymeric capsules comprising a polymeric shell having a diameter, a thickness and a second refractive index within 30% of the first refractive index of the polymeric matrix, a liquid core contained within the cavities and optically connected to the polymeric shell having a third refractive index within 30% of the first refractive index of the polymeric matrix; and a polishing surface comprising the polymeric matrix material and a plurality of asperities defined by the cavities of the embedded polymeric capsules exposed at the polishing surface.

DETAILED DESCRIPTION

Figure 1:
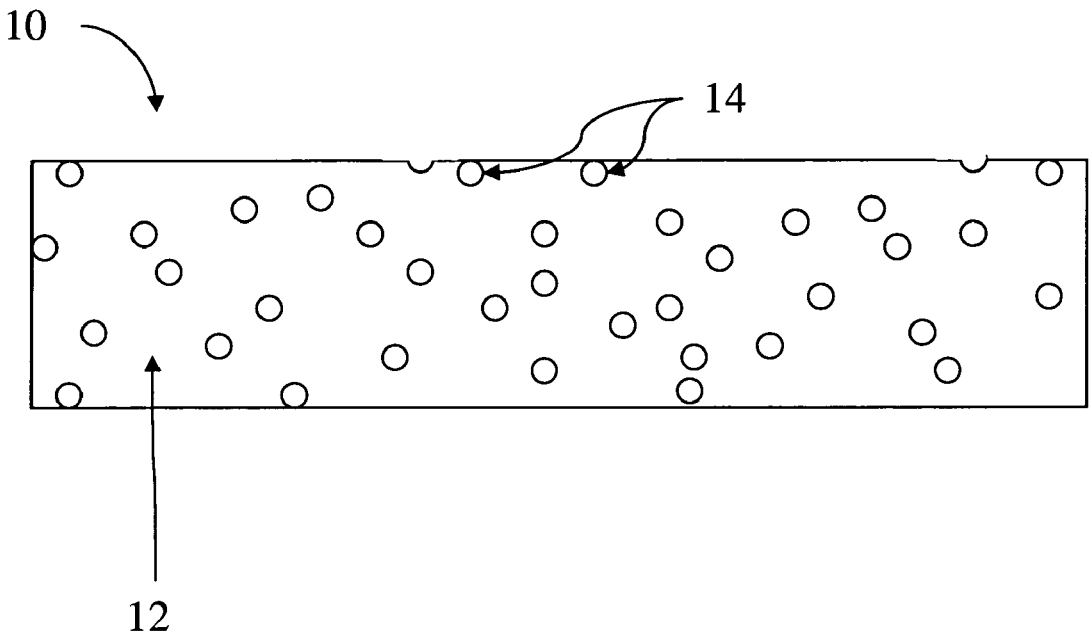
FIG. 1 is a schematic-partial-cross-sectional view of a polymeric capsule of the prior art.
Figure 2:
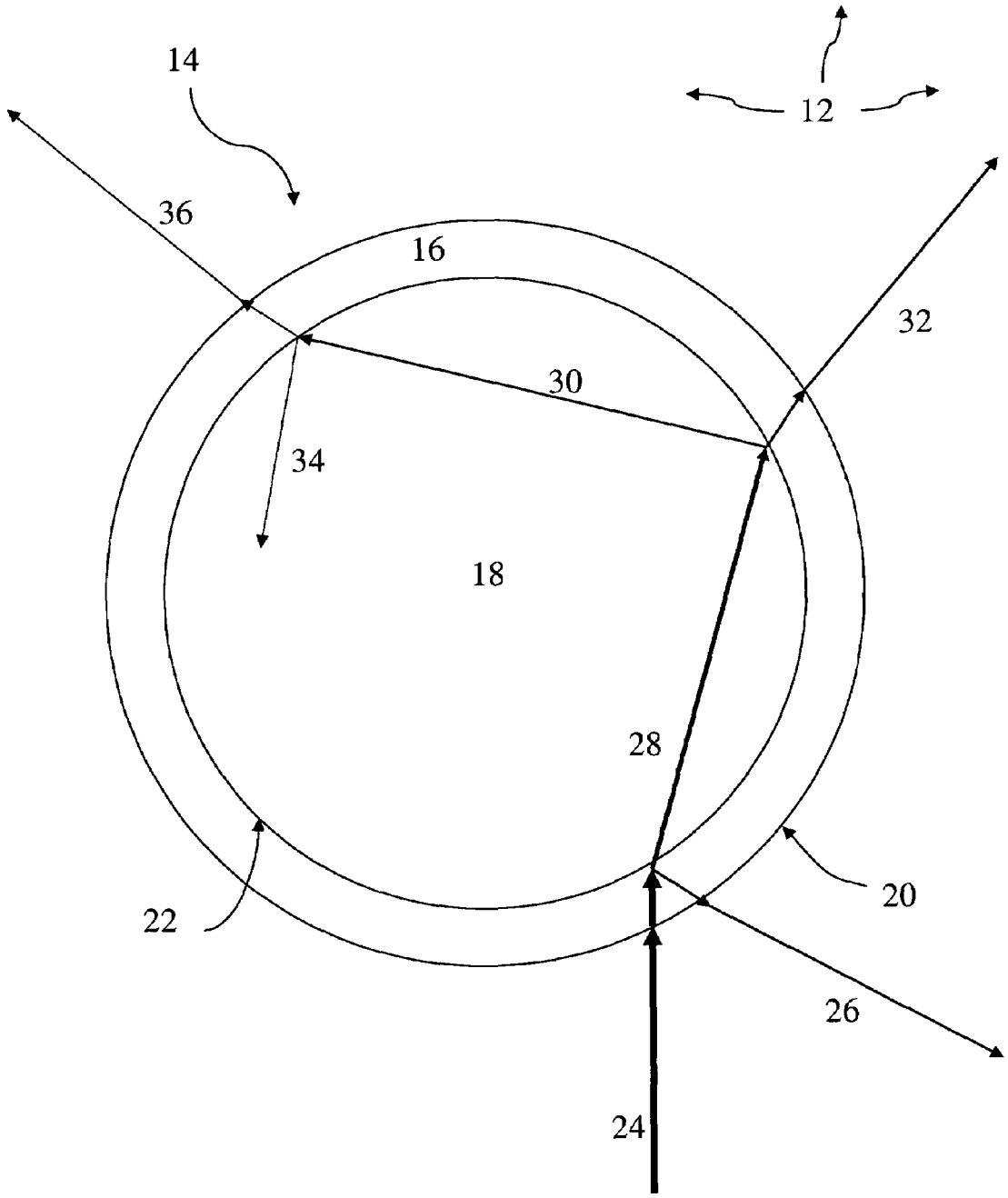
FIG. 2 is a schematic of a polymeric capsule of FIG. 1 for illustrating light scattering.
Figure 3:
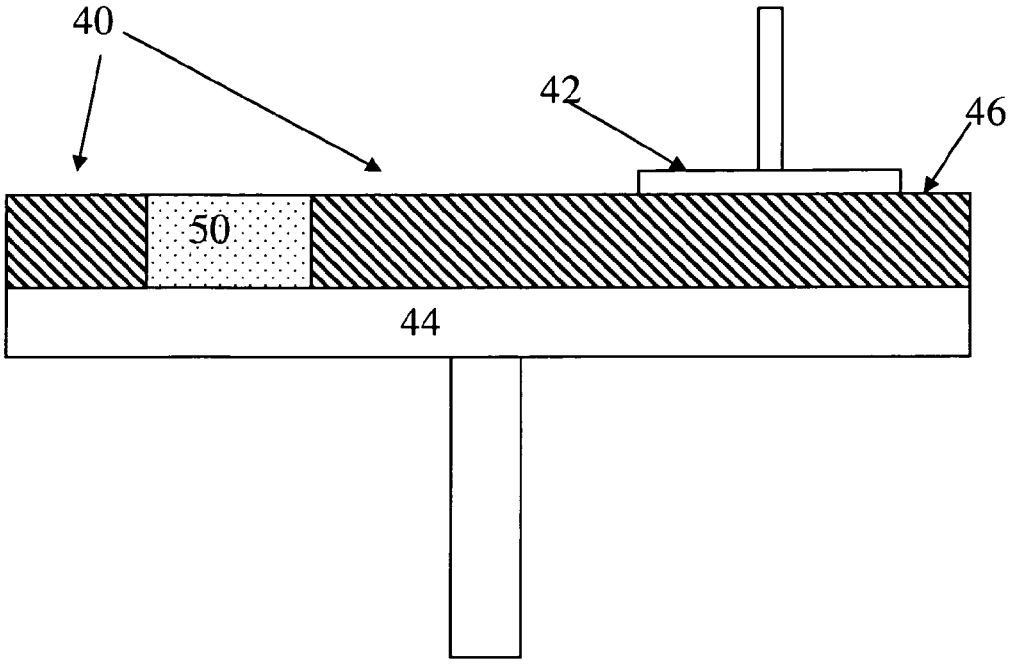
FIG. 3 is a schematic view illustrating the polishing pad of the present invention as used in a CMP process.

Referring to FIG. 3, the present invention provides a polishing pad 40, useful for planarizing a substrate 42 in a CMP process, which is transparent and can be used with an in-situ optical end-point detection apparatus (not shown) without the need for an aperture or window, eliminates seams though which polishing composition may leak, and requires fewer steps to manufacture. The polishing pad 40 is mounted on a platen 44 such that the polishing surface 46 faces up and contacts the substrate 42. Also shown is a region of the polishing pad 50 that is shown in greater detail in FIG. 4.

Figure 4:
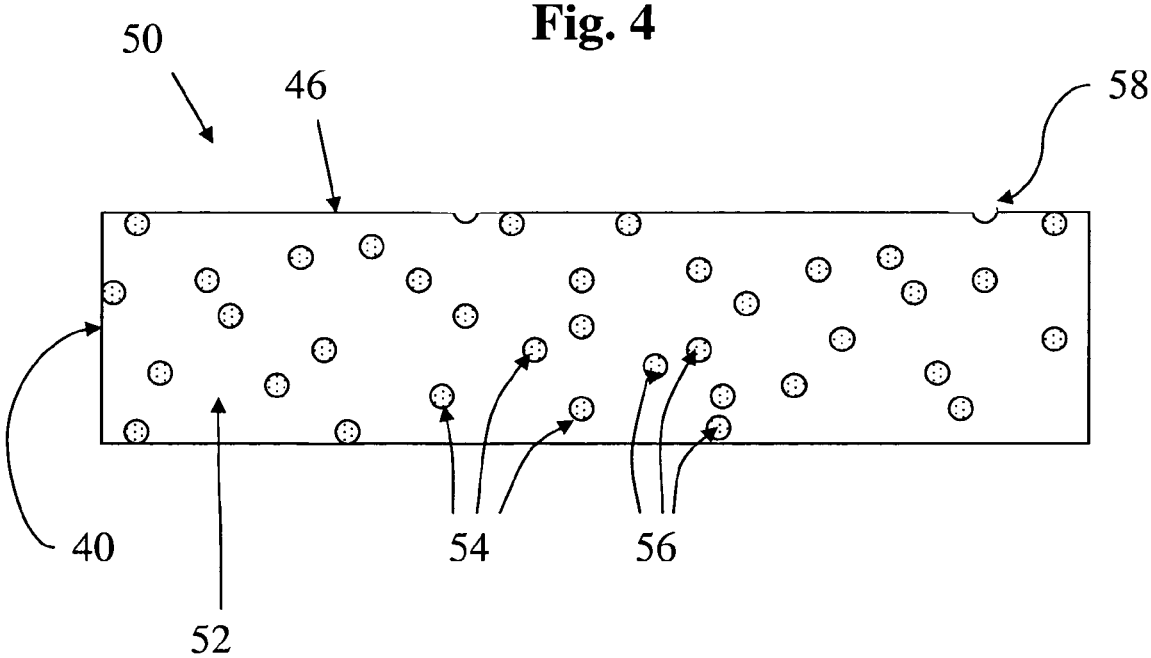
FIG. 4 is a schematic-partial-cross-sectional view of the polishing pad of FIG. 3.

As shown in FIG. 4, the polishing pad 40 is made from a polymeric matrix material 52 and includes polymeric capsules 54. The polymeric capsules 54 have a liquid core 56. FIG. 4 also shows pores 58 defined by the exposed cavity of the polymeric capsules 54 at or near the polishing surface 46. Each of the polymeric matrix material 52, the polymeric shell 70 (FIG. 5) and the liquid core 56 has a refractive index. In particular, the refractive index of the polymeric matrix material, the polymeric shell and the liquid core are similar such that the polishing pad is transparent and can be used for in-situ optical end-point detection. Preferably, the polishing pad is transparent to at least one wavelength of laser light that allows for in-situ optical end-point detection. Most preferably, the polishing pad is transparent to laser light of a wavelength of 640 to 670 nm.

The polymeric matrix material 52 may comprise a thermoplastic material, for example, a thermoplastic poly (vinylidene chloride) PDVC, polyurethane, polyvinyl chloride, ethylene vinyl acetate, polyolefin, polyester, polybutadiene, ethylene-propylene terpolymer, polycarbonate and polyethylene teraphthalate, and mixtures thereof. In addition, matrix material 52 may comprise a thermoset material, for example, a cross-linked polyurethane, epoxy, polyester, polyimide, polyolefin, polybutadiene and mixtures thereof. Preferably, the polymeric matrix material 52 comprises a polyurethane, and more preferably comprises a cross-linked polyurethane, such as IC 1000™ and VisionPad™ polishing pads manufactured by Rohm and Haas Electronic Materials CMP Technologies.

Figure 5:
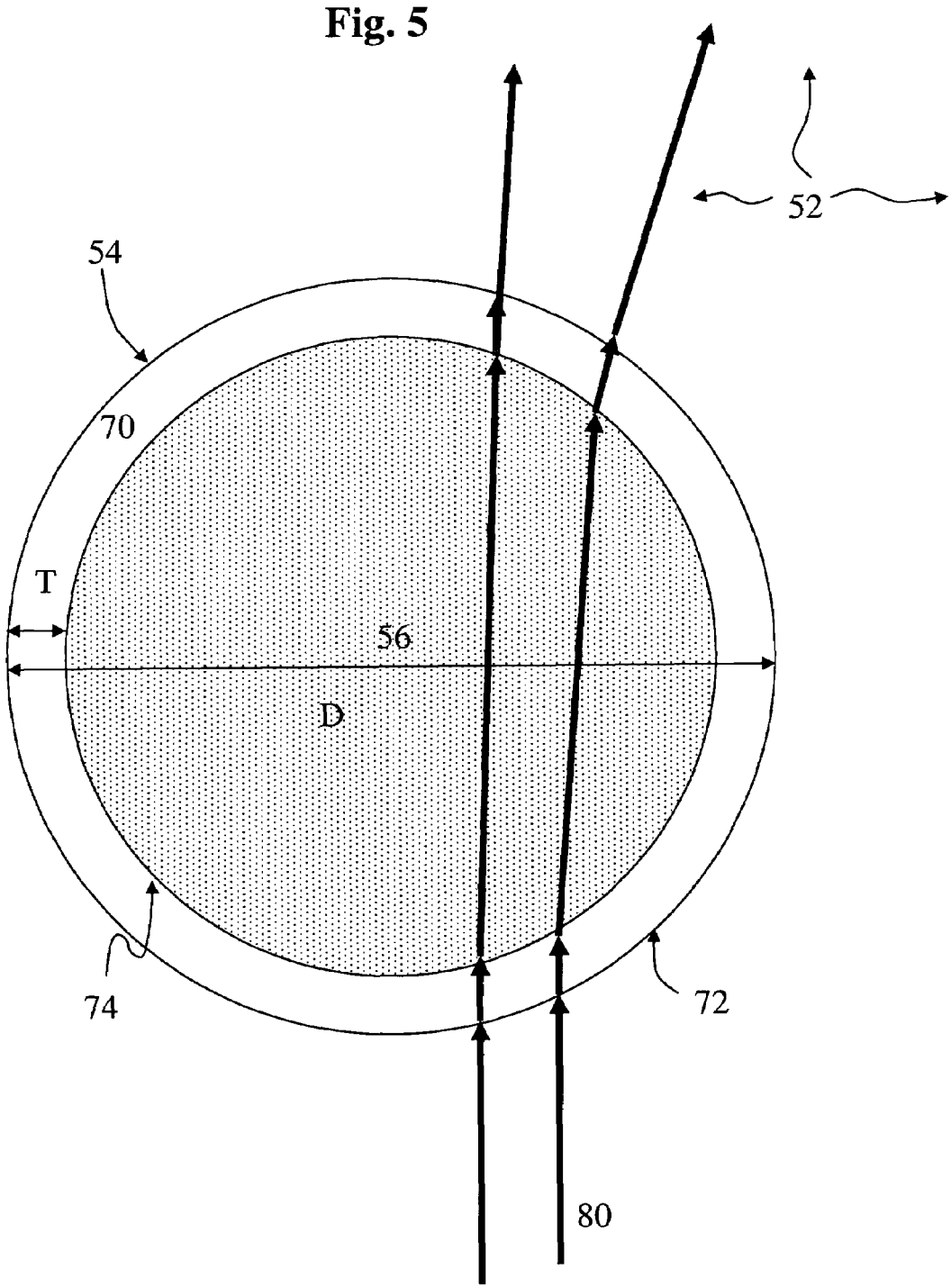
FIG. 5 is a schematic of a polymeric capsule of FIG. 4 for illustrating light transmission.

Referring to FIG. 5, the polymeric shell 70 may comprise a thermoplastic material, for example, a thermoplastic polyurethane, polyvinyl chloride, ethylene vinyl acetate, polyolefin, polyester, polybutadiene, ethylene-propylene terpolymer, polycarbonate and polyethylene teraphthalate, and mixtures thereof. In addition, the polymeric shell 70 may comprise a thermoset material, for example, a cross-linked polyurethane, epoxy, polyester, polyimide, polyolefin, polybutadiene and mixtures thereof. Preferably, the polymeric shell 70 comprises PDVC.

The polishing pad can be formed by conventional methods such as casting, injection molding, co-axial injection, extrusion, sintering, gluing, etc. Preferably the polishing pad 10 is formed by casting a sheet or a cake. When the polishing pad 10 is so formed, the mixture is transferred by pouring or injection into a mold, which can be open or closed. Optionally, sheets are continuously cast into a roll for increased production rates. The mixture is then preferably cured by the use of curing agents that can be light-activated, time-activated, thermal-activated or chemically-activated. Once cured, the batch is removed from the mold and cut into individual polishing pads by mechanical means such as skiving or stamping, or by laser cutting. Optionally, the polishing pad is formed by casting the mixture in a mold, curing, and skiving. The liquid core is particularly useful for limiting the pad-to-pad variation that may occur from casting polymeric cakes. For example, the exothermic reactions that can heat the center and top of the cake provide less thermal expansion to liquid-filled capsules than gas-filled capsules.

In addition to reducing capsule expansion and density non-uniformity, the ability of the liquid core to transfer heat serves to reduce or eliminate polymeric matrix material melting or charring during the grooving process. The liquid core serves to cool the polymeric matrix material around the grooves during forming by conducting heat away from the region and serves to raise the thermal mass of the polishing pad, lowering the temperature increase of the polymeric matrix material. Therefore, the polishing pad of the present invention can be grooved with less melting or charring and without the need for air-cooling or introduction of substantial amounts of water.

The liquid core 56 may comprise an aqueous or non-aqueous liquid, such as an alcohol. Preferably, the liquid core comprises an aqueous solution, for example, an aqueous solution of organic or inorganic salts, a solution of prepolymers or oligomers, or a solution of water soluble polymers. Optionally, the liquid core may also contain reagents for the CMP process. Most preferably the liquid core is water with only incidental impurities, such as deionized water with dissolved gases.

The polymeric capsule 54 has a diameter D, and is comprised of a polymeric shell 70 having a thickness T and a liquid core 56, contained within the polymeric shell 70. The thickness T is shown as relatively small compared to the diameter D of the polymeric capsule 54. Preferably, the polymeric shell 70 has a diameter D between 1 μm and 150 μm. More preferably, the polymeric capsule 54 has a diameter between 2 μm and 75 μm. Preferably, the polymeric capsule 54 has a thickness T between 0.01 μm and 5 μm. More preferably, the polymeric capsule 54 has a thickness T between 0.05 μm and 2 μm. The polymeric shell 70 prevents the liquid core 56 from contacting the polymeric matrix material 52 before the polishing pad 10 is formed and the polymeric shell 70 opens during polishing, such as conditioning or from wear against a wafer to create an asperity for allowing the polishing composition to displace the liquid core 56 and transporting the polishing composition. Alternatively, the polymeric shell 70 prevents the liquid core 56 from contacting the polymeric matrix 52 material before the polishing pad 10 is formed and the polymeric shell 70 dissolves after the polishing pad is formed creating a cavity in the polymeric matrix and the cavity is opened during polishing, creating an asperity for allowing the polishing composition to displace the liquid core 56 and transporting the polishing composition.

Generally, any two adjacent component materials that are optically connected create an interface at the point of connection. The polymeric capsule 54 has a first interface 72 where the polymeric shell 70 contacts the polymeric matrix material 52, and a second interface 74 where the polymeric shell 70 contacts the liquid core 56. When the refractive index of any component material differs from the refractive index of an adjacent and optically connected material, light rays passing from one material to the other will be substantially refracted at the interface. FIG. 5 shows light rays 80 that are incident on the surface of the polymeric capsule 54. As the light rays 80 encounter the first interface 72, they are refracted by only a very small amount as they pass through the first interface 72. Light rays 80 then encounter the second interface 74 where they are refracted. Light rays 80 then pass through the liquid core 56 and encounter the second interface 74 a second time, where they are refracted. Finally, light rays 80 encounter the first interface for a second time, are refracted, and exit the polymeric capsule. As seen in FIG. 5, incident light rays 80 are refracted only by a small amount and pass through the polymeric capsule 54 with only a small cumulative effect due to refraction.

A lesser difference between the refractive indexes of the two optically connected materials corresponds to a lesser degree of refraction. This refraction, especially small when small numbers of interfaces are encountered or when the polymeric matrix 52, polymeric shell 70 and liquid core 56 all have close indices of refraction. For transparent polishing pads it is preferable to use a clear subpad or a subpad with an opening that allows an optical signal to freely pass. Furthermore, leaving the pad ungrooved in a particular region can also improve the signal strength.

In addition to refraction, the relative difference in the refractive indexes of two optically connected materials affects reflection. Light rays encountering an interface with two optically connected materials having indexes of refraction that differ greatly will be partially reflected. The greater the difference between the refractive indexes of the two optically connected materials, the greater the percentage of light that will be reflected. This reflection, as with refraction, reduces the amount of light that passes through the polishing pad, creating opacity. Preferably, the refractive index of each of the polymeric matrix material is within 30% of the refractive indexes of the shell and liquid core. More preferably, the refractive index of each of the polymeric matrix material is within 25% of the refractive indexes of the shell and liquid core. Most preferably, the refractive index of each of the polymeric matrix material is within 20% of the refractive indexes of the shell and liquid core. For the purposes of this specification, a refractive index, r1 (polymer matrix), is within x % of a second refractive index, r2 (shell or liquid core), if the following is true:

$$(r1*(1-(x/100)))\leqq r2\leqq((1+(x/100))*r1).$$

Generally, the closer the refractive indices of the polymeric matrix, polymeric shell and the liquid core, the stronger the signal strength transmitted through to the wafer and reflected back for process monitoring. In addition, other factors such as the size, optical transmisivity and density of the polymeric capsules influence the signal strength. For example, the addition of a liquid core to the polymeric capsule can transform an optically opaque polishing pad unsuitable for chemical mechanical polishing into an optically transparent polishing pad suitable for endpoint detection with optical signals, such as those generated by lasers. In addition, the liquid core increases the pad's stiffness that can improve the pad's planarization ability. Furthermore, the liquid core improves the thermal conductivity of the pad in comparison to gas-filled polymeric capsules. Finally, the liquid core can improve the polishing pad's machinability for cutting grooves and especially cutting complex grooves, such as modified radial grooves.

The invention claimed is:

1. A transparent polishing pad useful for polishing a substrate in a chemical mechanical polishing process using a polishing composition and an in-situ optical end-point detection apparatus, the polishing pad comprising:

a polymeric matrix material having a first refractive index;

a plurality of polymeric capsules having cavities embedded within and optically connected to the polymeric matrix material, the polymeric capsules comprising a polymeric shell having a diameter, a thickness and a second refractive index within 30% of the first refractive index of the polymeric matrix, a liquid core contained within the cavities and optically connected to the polymeric shell having a third refractive index within 30% of the first refractive index of the polymeric matrix, the liquid core being water with incidental impurities; and a polishing surface comprising the polymeric matrix material and a plurality of asperities defined by the cavities of the embedded polymeric capsules exposed at the polishing surface.

2. The polishing pad of claim 1 wherein the polymeric shell prevents the liquid core from contacting the polymeric matrix material before the polishing pad is formed and the polymeric shell opens during polishing to create an asperity for allowing the polishing composition to displace the liquid core and transporting the polishing composition.

3. The polishing pad of claim 1 wherein the polymeric shell prevents the liquid core from contacting the polymeric matrix material before the polishing pad is formed and the polymeric shell dissolves after the polishing pad is formed creating a cavity in the polymeric matrix and the cavity opens during polishing to create an asperity for allowing the polishing composition to displace the liquid core and transporting the polishing composition.

4. The polishing pad of claim 1 wherein the diameter of the polymeric capsule is 1 μm to 150 μm.

5. The polishing pad of claim 1 wherein the polishing pad is transparent to at least one wavelength of laser light that allows for in-situ optical end-point detection.

6. The polishing pad of claim 5 wherein the polishing pad is transparent to laser light of a wavelength of 640 nm to 670 nm.

7. The polishing pad of claim 1 wherein the polymeric shell has a thickness of 0.1 to 5 μm.

8. The polishing pad of claim 1 wherein the polymeric shell is PDVC.

9. The polishing pad of claim 1 wherein the second refractive index refractive index of the polymeric shell is within 20% of the first refractive index of the polymeric matrix, and the third refractive index of the liquid core is within 20% of the first refractive index of the polymeric matrix.

* * * * *